United States Patent [19]

Teranishi

[11] Patent Number: 4,971,262

[45] Date of Patent: Nov. 20, 1990

[54] METHOD AND APPARATUS FOR WINDING YARNS

[75] Inventor: Junichi Teranishi, Ohtsu, Japan

[73] Assignee: Murata Kikai Kabushiki Kaisha, Kyoto, Japan

[21] Appl. No.: 405,451

[22] Filed: Sep. 11, 1989

[30] Foreign Application Priority Data

Sep. 13, 1988 [JP] Japan ..... 63-228954

[51] Int. Cl.[5] ..... B65H 54/28; B65H 54/38

[52] U.S. Cl. ..... 242/43 R; 242/18.1

[58] Field of Search ..... 242/43 R, 43.1, 18.1

[56] References Cited

U.S. PATENT DOCUMENTS

| | | | |
|---|---|---|---|
| 3,402,898 | 9/1968 | Mattingly | 242/43 R |
| 3,489,360 | 1/1970 | Torsellini et al. | 242/18.1 X |
| 3,659,796 | 5/1972 | Bucher et al. | 242/18.1 |
| 3,727,855 | 4/1973 | Richter | 242/18.1 |
| 3,982,706 | 9/1976 | Delerue | 242/18.1 |
| 4,006,863 | 2/1977 | Bense | 242/18.1 |
| 4,325,517 | 4/1982 | Schippers et al. | 242/43 R X |
| 4,498,637 | 2/1985 | Yamamoto et al. | 242/18.1 |
| 4,544,113 | 10/1985 | Yoshinaga et al. | 242/43 R X |
| 4,555,069 | 11/1985 | Maeda et al. | 242/43 R |
| 4,674,694 | 6/1987 | Hasegawa et al. | 242/43 R |
| 4,767,071 | 8/1988 | Hirai | 242/18.1 |
| 4,771,960 | 9/1988 | Yamamoto et al. | 242/18.1 |

FOREIGN PATENT DOCUMENTS

| | | | |
|---|---|---|---|
| 518750 | 2/1931 | Fed. Rep. of Germany | 242/43.1 |

*Primary Examiner*—Stanley N. Gilreath

*Attorney, Agent, or Firm*—Spensley Horn Jubas & Lubitz

[57] ABSTRACT

A method and apparatus for winding yarns in a package comprises displacing a traverse guide of a yarn to be traversed and moved leftward and rightward along an axial direction of a winding package, in a direction toward and away from the winding package together with the traverse movement.

19 Claims, 3 Drawing Sheets

METHOD AND APPARATUS FOR WINDING YARNS

FIELD OF THE INVENTION

This invention relates to a method and apparatus for winding yarns on a package.

RELATED ART STATEMENT

In the yarn winding device, creeping operation is carried out in order to prevent an occurrence of edge-raising at an end of a yarn layer of a winding package.

That is, a yarn is normally guided by a traverse guide and traversed in an axial direction (left and right) of a package and then wound. The traverse width is increased or decreased as time passes to relatively reduce a winding amount at the end of the package to prevent the edge-raising.

The apparatus for effecting the creeping operation is the apparatus disclosed, for example, in Japanese Patent Publication No. 34627/1984.

However, in such a conventional apparatus as described, the traverse guide moves traversing on an approximately straight line close to the winding package. Therefore, a mechanism for driving the traverse guide leftward and rightward and a mechanism for changing a traverse width at the time of traverse becomes unavoidably complicated, and there is a disadvantage that the interior of the traverse device becomes extremely complicated due to the presence of a cam, a lever and the like. If the interior of the traverse device is complicated, troubles tend to occur, and the presence of a number of cams, levers and the like greatly obstructs for formation of higher speed operation.

OBJECT AND SUMMARY OF THE INVENTION

An object of the present invention is to provide a new method and apparatus for winding yarns on a package, which can positively perform the creeping operation and which is simple in mechanism and hard to produce troubles.

The method for winding yarns according to an embodiment of the present invention comprises displacing a traverse guide of a yarn to be traversed and moved leftward and rightward along an axial direction of a winding package, in a direction toward and away from the winding package together with the traverse movement. And the apparatus for winding yarns according to the present invention comprises a traverse guide of a yarn disposed movably in a direction toward and away from a winding package while being traversed and driven leftward and rightward in an axial direction of the winding package, and a guide slit for defining a position in a direction toward and away from the winding package of the traverse guide extending in said axial direction and extending therethrough, wherein said guide slit can be moved toward and away from the package and a drive source in said direction toward and away is connected to said guide slit.

DETAILED DESCRIPTION OF PREFERRED EMBODIMENT

Embodiments will be described hereinafter with reference to the drawings.

Figure 1:
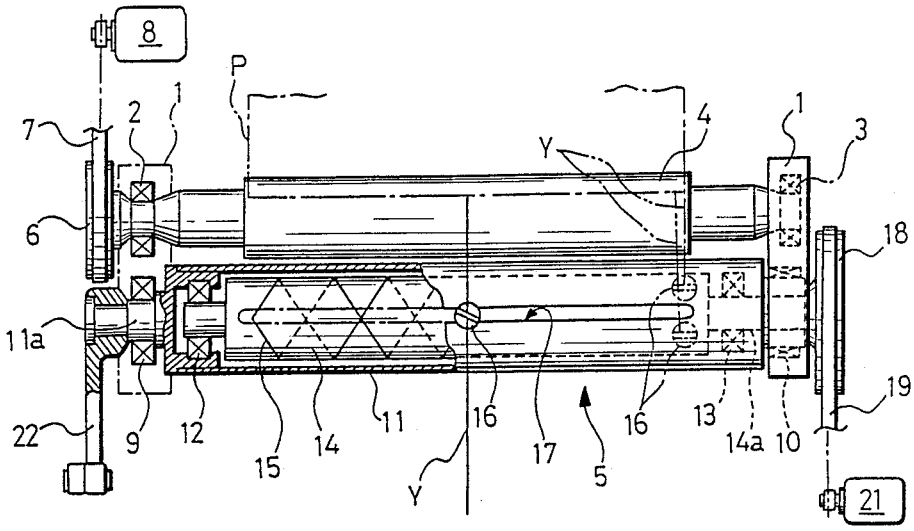
FIG. 1 is a partly cutaway front view of apparatus according to a first embodiment of the present invention.
Figure 2:
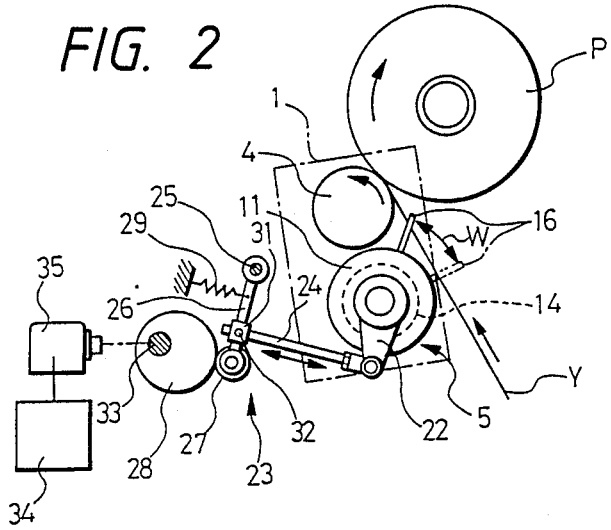
FIG. 2 is a side view of the same.

A first embodiment is shown in FIGS. 1 to 4, FIG. 1 is a partly cutaway front view, and FIG. 2 is a side view.

A traverse device according to this embodiment comprises a friction drum 4 supported on bearings 2 and in left and right bearing frames 1, and a traverse guide 5 likewise supported on the bearing frames 1. A winding package P supported by a cradle arm not shown is in rolling contact with the friction drum 4 and rotatably driven.

An electric motor 8 is connected to a pulley 6 secured to the end of the friction drum 4 through an endless belt 7 and driven.

The traverse guide 5 comprises a cylindrical casing 11 of which both ends are supported by bearings 9 and 10 on the bearing frame 1, a cam drum 14 supported by bearings 12 and 13 rotatably within the casing 11, and a traverse guide 16 in engagement with an unlimited spiral-like cam groove 15 formed externally of the cam drum 14. The traverse guide 16 has its shoe portion **16*a* (FIG. 3) engaged with the cam groove 15 and has its base 16*b* engaged with a straight-line guide slit 17 formed in the casing 11 so that when the cam drum 14 is rotatively driven, the lateral traverse motion is effected along the guide slit 17**.

That is, a small diameter portion at one end of the cam drum 14 extends through the casing 11 and protrudes sidewards, and a pulley 18 is provided on the extreme end thereof, which is connected to an electric motor 21 through an endless belt 19 and driven.

In this embodiment, a lever 22 is secured to a projecting portion **11*a* at one end of the cylindrical casing 11 which is rotatable as mentioned above, and a drive device 23 which will be described below is connected to the lever 22**.

That is, a second lever 26 pivotable about a fixed pivot 25 is connected to the end of the lever 22 through a link 24. A roller 27 at the end of the second lever 26 is placed in rolling contact with an eccentric cam 28, and the lever 22 is slidably moved by the eccentric rotation of the eccentric cam 28. The guide slit 17 is reciprocatingly rotated about the cam drum 14.

Reference numeral 29 designates a tension spring for biasing the second lever 26 in a direction of the cam 28, and 31 a connection of the link 24 to the second lever 26. When a set screw 32 provided on the connection 31 is loosened, the effective length of the link 24 is adjusted so that the range of reciprocating angle W can be changed.

A shaft 33 of the eccentric cam 28 is connected to a stepping motor 35 controlled by a computer 34, the eccentric cam 28 being rotated at a rotational speed and at a rotational angle preprogrammed within the computer. It is of course that a rotational pattern can be changed by replacing the eccentric cam 28.

A guide portion **16*c* of the traverse guide 16 in this embodiment is in the form of an approximately triangle in which a base portion 16b is formed to be wide in width, and when a yarn Y is guided by the base 16b**, a free moving width of the yarn becomes large.

The function of the above-described first embodiment will be described hereinafter.

When the cam drum 14 is rotatively driven by the electric motor 21, the traverse guide 16 is guided by the cam groove 15 and the guide slit 17 and reciprocatingly driven in a lateral direction shown in FIG. 1. However, the guide slit 17 is reciprocatingly rotated about the axis of the cam drum 14 by the drive device 23, and therefore, the traverse guide 16 is moved leftward and rightward and at the same time reciprocatingly displaced also in a direction toward and away from the package P (FIG. 1—phantom outline⟷dash-dotted contour lines and FIG. 2—solid line→dash-two dotted line).

Figure 4:
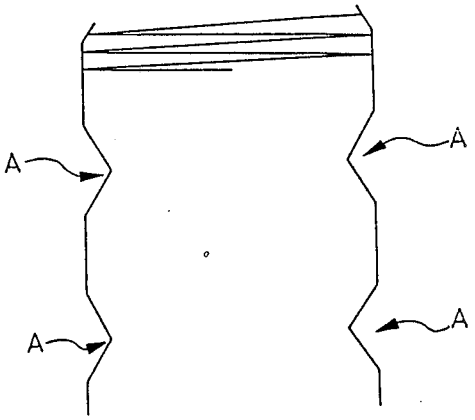
FIG. 4 is a view showing a creeping pattern.

Accordingly, even if the widths of left and right movements of the traverse guide 16 itself are the same due to the winding tension of the yarn, the more movement of the traverse guide 16 away from the winding package P, the winding position of the yarn onto the package P is moved toward the central portion lengthwise of the package P (FIG. 1—phantom (one dot) outline→phantom (two dots) outline), as a consequence of which a creeping pattern as shown in FIG. 4 in which the winding width is periodically reduced is depicted to effect winding.

In FIG. 4, a portion indicated at arrow A in which traverse width is reduced is a section in which traverse guide 16 is moved away from the package P, that is, a section in which guide slit 17 is rotated clockwise in FIG. 2.

In this embodiment, the section in which traverse guide 16 is rotated is set between the solid line and the chain line in FIG. 2 with respect to the yarn running area. When the traverse guide 16 moves close to the package P, the yarn Y is guided by the extreme end of the guide 16, whereas when the traverse guide 16 is moved away from the package P, the yarn Y is guided by the base 16b. Therefore, as the traverse guide 16 moves in a lateral direction, the yarn comes into contact with the guide 16 at a position shown next, and when the traverse guide 16 is moved away from the package P, the amount in reduction of the traverse width increases.

Figure 3:
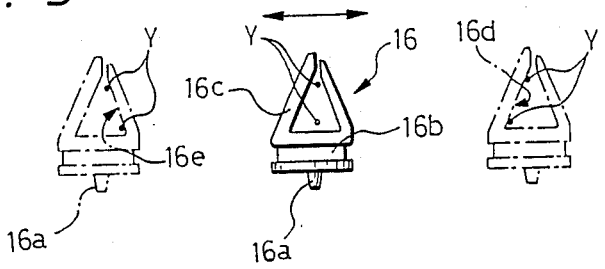
FIG. 3 is an explanatory view showing the operation of a traverse guide and a guiding state of yarn.

That is, as shown in FIG. 3, when the traverse guide moves rightward, the yarn Y is guided by the left-hand inner wall 16d of the guide, whereas when the traverse guide moves leftward, the yarn is guided by the right-hand inner wall 16e thereof. However, the yarn Y moves toward the wide width portion as the traverse guide 16 moves away from the package P, and therefore, even at the passage position of the yarn with respect to the traverse guide 16, the yarn moves toward the central portion lengthwise of the package P.

It is of course that the creeping pattern (FIG. 4) in the above-described embodiment may be easily changed by replacing the eccentric cam 28 or changing a program for controlling the stepping motor 35.

Figure 5:
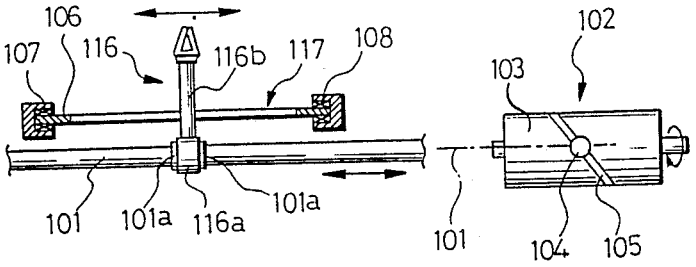
FIG. 5 is a front view partly in section of apparatus according to a second embodiment.

A second embodiment will be described hereinafter with reference to FIGS. 5 and 6.

That is, in this embodiment, a traverse guide 116 has its base 116a rotatably and non-slidably connected to a traverse shaft 101, the traverse shaft 101 being connected to a known traverse drive source 102 connected to the base of the traverse shaft 101 so that a traverse guide 116 may be moved leftward and rightward.

Reference numeral 101a designates a flange portion secured to the traverse shaft 101, and 103 a cam drum having a cam groove 105 with which a shoe 104 at the end of the shaft 101 is engaged.

In this embodiment, a base of the traverse guide 116 is in the form of a plate 116b, and a guide slit 117 is provided through which the plate-like base 116b extends.

Figure 6:
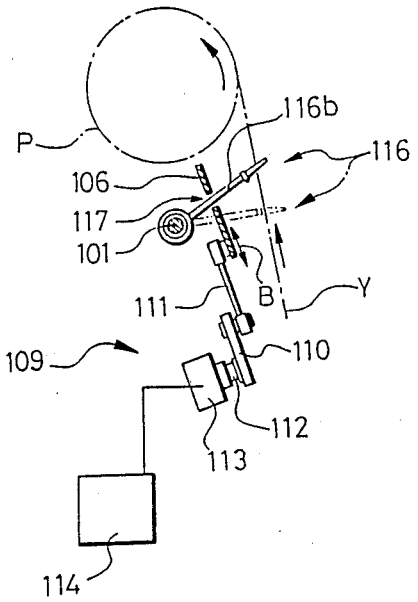
FIG. 6 is a side view of the same.

The guide slit 117 is bored in a linear form in the surface of a slide plate 106, the slide plate 106 being supported at its both ends by linear bearings 107 and 108 for reciprocating movement in a direction as indicated at arrow B in FIG. 6.

That is, in this embodiment, the guide slit 117 is linearly moved toward and away from the package P, whereby the traverse guide 116 is moved toward and away from the package P.

A drive device 109 described below is connected to the slide plate 106 in a manner similar to the previous embodiment.

That is, it comprises a rod 111 having one end connected to the slide plate 106 and the other end connected to an eccentric disc 110 and a stepping motor 113 directly coupled to an eccentric shaft 112 of the eccentric disc 110. The stepping motor 113 is also controlled by a computer 114 which stores in advance an operating pattern.

Figure 7:
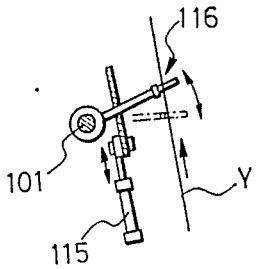
FIG. 7 is a side view showing another embodiment of a drive device.

In the second embodiment, since the slide plate 106 having a guide slit is linearly moved, the drive device 109 may comprises a linear actuator 115, for example, such as a fluid cylinder, a solenoid or the like, in place of the one comprising the motor 113 and the eccentric disc 110 (FIG. 7) to further simplifying the construction.

As will be apparent from the above description, according to the present invention, there can be obtained a traverse device which is simple in construction and which is rarely sufferred from troubles. In addition, the creeping operation which has not been realized unless a complicated mechanism is employed can be realized simply and positively.

What is claimed is:

1. A method of winding yarn about the axis of a winding package, the method comprising the steps of:

rotating the package about its axis;

guiding the yarn to the package with a traverse guide;

moving the traverse guide in substantially the axial direction of the winding package to guide the yarn along substantially the axial direction of the winding package;

moving the traverse guide toward and away from the winding package while moving the traverse guide in substantially the axial direction of the package.

2. A method as claimed in claim 1, wherein:

the step of guiding the yarn to the package comprises the step of guiding the yarn to a winding location on the peripheral surface of the winding package the winding location traversing the peripheral surface of the winding package as the yarn is guided along substantially the axial direction of the winding package; and the step of moving the traverse guide toward and away from the winding package comprises the step of periodically moving the traverse guide away from the package to periodically move the winding location toward the central portion of the length of the peripheral surface of the winding package.

3. A method as claimed in claim 2, wherein the step of moving the traverse guide toward the winding package further comprises the step of moving the traverse guide toward the winding package between the periodic movements of the traverse guide away from the winding package.

4. Apparatus for winding yarn about the axis of a winding package rotating about its axis, the apparatus comprising:

a yarn guide for guiding the yarn to the package;

traversing means for traversing the yarn guide in substantially the axial direction of the winding package; and displacing means for providing relative displacement of the yarn guide toward and away from the winding package simultaneously with the traversing of the yarn guide in substantially the axial direction of the winding package.

5. Apparatus as claimed in claim 4, wherein the displacing means comprises:

a first member having a slit extending substantially in the axial direction of the winding package, and means for displacing the slit of the first member toward and away from the winding package;

wherein the yarn guide has a base portion extending through the slit of the first member.

6. Apparatus as claimed in claim 4, wherein the displacing means comprises a substantially cylindrical casing having a guide slit extending substantially in the axial direction of the winding package;

the yarn guide has a base portion extending through the guide slit of the cylindrical casing;

the traversing means comprises a cam drum rotatably supported within the cylindrical casing and having a peripheral surface provided with a spiral-like cam groove; and the yarn guide further has a cam follower engaged with the cam groove of the cam drum.

7. Apparatus as claimed in claim 6, further comprising:

first drive means for rotating the cam drum with respect to the cylindrical casing, to guide the cam follower of the yarn guide by the cam groove of the cam drum and to move the yarn guide along the guide slit;

wherein the means for moving the guide slit comprises second drive means for rotating the cylindrical casing.

8. Apparatus as claimed in claim 7, wherein the second drive means comprises:

a lever member connected to the cylindrical casing, the lever being moveable to rotate the cylindrical casing about its axis;

a roller connected to the lever member;

a rotatably supported eccentric cam, engaged with the roller, the eccentric cam being rotatable for moving the lever, and a stepping motor connected to rotate the eccentric cam.

9. Apparatus as claimed in claim 5, wherein the yarn guide comprises a guide member extending from the base portion and defining a substantially triangular yarn passage, the substantially triangular yarn passage having a wide portion adjacent the base portion.

10. Apparatus as claimed in claim 6, wherein the yarn guide comprises a guide member extending from the base portion and defining a substantially triangular yarn passage, the substantially triangular yarn passage having a wide portion adjacent the base portion.

11. Apparatus for winding yarn about the peripheral surface of a winding package which is rotating about its axis to form a yarn package, the apparatus comprising:

a moveable yarn guide for guiding the yarn to the package, the yarn guide defining a yarn passage through which yarn to be wound about the winding package passes, the yarn passage being moveable with the yarn guide;

first drive means for moving the moveable yarn guide substantially parallel to the peripheral surface of the winding package during the formation of a yarn package;

second drive means for providing relative movement of the moveable yarn guide toward and away from the winding package simultaneously with the moving of the moveable yarn guide substantially parallel to the peripheral surface of the winding package;

wherein, the yarn passing through the yarn passage is guided in a path traversing the peripheral surface of the winding package upon movement of the moveable yarn guide substantially parallel to the peripheral surface of the winding package; and wherein the location at which the yarn extends from the winding package is moved toward the central portion of the length of the traversed path of the yarn upon movement of the moveable yarn guide away from the winding package.

12. Apparatus as claimed in claim 11, wherein the second drive means comprises means for periodically moving the moveable yarn guide away from the winding package during the formation of the yarn package.

13. Apparatus as claimed in claim 12, wherein the second drive means further comprises means for moving the moveable yarn guide toward the winding package between the periodic movements of the moveable yarn guide away from the winding package.

14. Apparatus as claimed in claim 11, wherein the second drive means comprises:

a first member having a slit extending substantially parallel with the peripheral surface of the winding package; and p1 means of displacing the slit of the first member toward and away from the winding package;

wherein the yarn guide has a base portion extending through the slit of the first member.

15. Apparatus as claimed in claim 1, wherein:

the second drive means comprises a substantially cylindrical casing having a guide slit extending substantially parallel to the peripheral surface of the winding package;

the yarn guide has a base portion extending through the guide slit of the cylindrical casing;

the first drive means comprises a cam drum rotatably supported within the cylindrical casing and having a peripheral surface provided with a spiral like cam groove; and the yarn guide has a cam follower engaged with the cam groove of the cam drum.

16. Apparatus as claimed in claim 15, further comprising:

first rotary drive means for rotatably driving the cam drum with respect to the cylindrical casing, to guide the cam follower of the yarn guide by the cam groove of the cam drum and to move the yarn guide along the guide slit;

wherein the means for moving the guide slit comprises second rotary drive means for rotatably driving the cylindrical casing.

17. Apparatus as claimed in claim 16, wherein the second rotary drive means comprises:

a lever member connected to the cylindrical casing, the lever being moveable to rotate the cylindrical casing about its axis;

a roller connected to the lever member;

a rotatably supported eccentric cam, engaged with the roller, the eccentric cam being rotatable for moving the lever; and a stepping motor connected to rotate the eccentric cam.

18. Apparatus as claimed in claim 14, wherein the yarn guide comprises a guide member extending from the base portion and wherein the yarn passage comprises a substantially triangular passage provided in the guide member.

19. Apparatus as claimed in claim 16, wherein the yarn guide comprises a guide member extending from the base portion and wherein the yarn passage comprises a substantially triangular shaped passage provided in the guide member.

* * * * *